US008992771B2

(12) United States Patent
Wigand et al.

(10) Patent No.: US 8,992,771 B2
(45) Date of Patent: *Mar. 31, 2015

(54) ISOLATING LUBRICATING OILS FROM SUBSURFACE SHALE FORMATIONS

(75) Inventors: Marcus Oliver Wigand, San Ramon, CA (US); Saleh Elomari, San Ramon, CA (US); Robert Martin Carlson, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 253 days.

This patent is subject to a terminal disclaimer.

(21) Appl. No.: 13/481,303

(22) Filed: May 25, 2012

(65) Prior Publication Data

US 2013/0313160 A1 Nov. 28, 2013

(51) Int. Cl.
*C10G 1/04* (2006.01)
*E21B 43/16* (2006.01)
(Continued)

(52) U.S. Cl.
CPC ..... *C10M 101/02* (2013.01); *C10M 105/04* (2013.01); *C10M 177/00* (2013.01); *C10N 2260/02* (2013.01); *E21B 43/16* (2013.01); *E21B 43/34* (2013.01); *F17D 1/16* (2013.01)
USPC ..... 208/311; 208/314; 166/300; 166/305.1; 166/369; 166/371

(58) Field of Classification Search
CPC ..... C10G 1/00; C10G 1/002; C10G 1/04; C10M 101/02; E21B 43/16; E21B 43/34
USPC ..... 166/300, 305.1, 307, 369, 371; 208/311, 314, 390, 391, 428, 435
See application file for complete search history.

(56) References Cited

U.S. PATENT DOCUMENTS 1,269,747 A 6/1918 Rogers
2,969,226 A 1/1961 Huntington
(Continued)

FOREIGN PATENT DOCUMENTS

WO WO2005010320 A1 2/2005
WO WO2011007172 A2 1/2011

OTHER PUBLICATIONS

Lynch, T, Process Chemistry of Lubricant Base Stocks, 2008, CPC Press, p. 1-20 & 355-366.*
(Continued)

*Primary Examiner* — Walter D Griffin
*Assistant Examiner* — Derek Mueller

(57) ABSTRACT

Disclosed herein are methods for isolating heavy saturated hydrocarbons from a subsurface shale formation comprising kerogen and an extractible organics component. These methods can be used to provide a bright stock product. The process comprises extracting an extractible organics component from subsurface shale formations comprising kerogen and the extractible organics component in an inorganic matrix and isolating a heavy hydrocarbon fraction comprising saturated beta-carotene. The methods utilize a hydrocarbon solvent to at least partially solubilize the extractible organics component. Among other factors, these processes are based on the discovery that the extractible organics is composed of a heavy hydrocarbon component containing saturated beta-carotene. The saturated beta-carotene product is a valuable commercial product. The presently disclosed processes are more environmentally benign, more economical, and more efficient in producing commercial products and in providing access to kerogen.

27 Claims, 2 Drawing Sheets

(51) Int. Cl.

| | |
|---|---|
| ***E21B 43/22*** | (2006.01) |
| ***E21B 43/34*** | (2006.01) |
| ***C10M 101/02*** | (2006.01) |
| ***C10M 105/04*** | (2006.01) |
| ***C10M 177/00*** | (2006.01) |
| ***F17D 1/16*** | (2006.01) |

(56) References Cited

U.S. PATENT DOCUMENTS 3,001,775 A 9/1961 Allred
3,001,776 A 9/1961 Poollen et al.
3,017,168 A 1/1962 Carr
3,061,009 A 10/1962 Shirley
3,076,762 A 2/1963 Dill
3,127,935 A 4/1964 Poettmann et al.
3,136,361 A 6/1964 Marx
3,139,928 A 7/1964 Broussard
3,205,942 A 9/1965 Sandberg
3,223,158 A 12/1965 Baker
3,228,468 A 1/1966 Nichols
3,241,611 A 3/1966 Dougan
3,280,910 A 10/1966 Crider
3,285,335 A 11/1966 Reistle, Jr.
3,292,699 A 12/1966 Slusser et al.
3,322,194 A 5/1967 Strubhar
3,342,258 A 9/1967 Prats
3,342,261 A 9/1967 Bond
3,346,044 A 10/1967 Slusser
3,349,848 A 10/1967 Burgh
3,358,756 A 12/1967 Vogel
3,362,471 A 1/1968 Slusser et al.
3,382,922 A 5/1968 Needham
3,398,793 A 8/1968 Milton, Jr.
3,400,762 A 9/1968 Peacock et al.
3,434,757 A 3/1969 Prats
3,437,378 A 4/1969 Smith
3,442,789 A 5/1969 Zimmerman, Jr.
3,455,383 A 7/1969 Prats et al.
3,468,376 A 9/1969 Bramhall et al.
3,474,863 A * 10/1969 Deans et al. ..... 166/266
3,478,825 A 11/1969 Closmann
3,480,082 A 11/1969 Gilliland
3,481,398 A 12/1969 Prats
3,489,672 A 1/1970 Shuman
3,499,490 A 3/1970 Needham et al.
3,500,913 A 3/1970 Closmann et al.
3,502,372 A 3/1970 Prats
3,503,868 A 3/1970 Shields
3,504,747 A 4/1970 Fitch et al.
3,513,913 A 5/1970 Bruist
3,515,213 A 6/1970 Prats
3,521,709 A 7/1970 Needham
3,537,528 A 11/1970 O'Brien et al.
3,548,938 A 12/1970 Parker
3,554,283 A 1/1971 Abrams
3,561,532 A 2/1971 Roberts et al.
3,565,171 A 2/1971 Closmann
3,578,080 A 5/1971 Closmann
3,593,789 A 7/1971 Prats
3,593,790 A 7/1971 Herce
3,601,193 A 8/1971 Grady
3,661,423 A 5/1972 Garret
3,666,014 A 5/1972 Beard
3,700,280 A 10/1972 Papadopoulos et al.
3,766,982 A 10/1973 Justheim
3,779,601 A 12/1973 Beard
3,804,169 A 4/1974 Closmann
3,804,172 A 4/1974 Closmann et al.
3,882,941 A 5/1975 Pelofsky
3,950,029 A 4/1976 Timmins
3,994,343 A 11/1976 Cha et al.
4,005,752 A 2/1977 Cha
4,008,761 A 2/1977 Fisher et al.
4,008,762 A 2/1977 Fisher et al.
4,018,280 A 4/1977 Daviduk et al.
4,026,360 A 5/1977 Drinkard
4,027,731 A 6/1977 Smith et al.
4,027,917 A 6/1977 Bartel et al.
4,029,360 A 6/1977 French
4,036,299 A 7/1977 Cha et al.
4,061,190 A 12/1977 Bloomfield
4,065,183 A 12/1977 Hill et al.
4,067,390 A 1/1978 Camacho et al.
4,072,350 A 2/1978 Bartel et al.
4,076,312 A 2/1978 Cha et al.
4,082,145 A 4/1978 Elkington
4,082,146 A 4/1978 Compton et al.
4,083,604 A 4/1978 Bohn et al.
4,084,640 A 4/1978 Allred
4,091,869 A 5/1978 Hoyer
4,105,072 A 8/1978 Cha
4,108,760 A 8/1978 Williams et al.
4,109,718 A 8/1978 Burton
4,126,180 A 11/1978 Cha
4,130,474 A 12/1978 Anthony
4,140,180 A 2/1979 Bridges et al.
4,144,935 A 3/1979 Bridges et al.
4,147,388 A 4/1979 French
4,147,389 A 4/1979 Bartel et al.
4,148,358 A 4/1979 Compton
4,148,359 A 4/1979 Laumbach et al.
4,151,068 A 4/1979 McCollum et al.
4,156,461 A 5/1979 Cha
4,158,467 A 6/1979 Larson et al.
4,162,808 A 7/1979 Kvapil et al.
4,166,721 A 9/1979 Cha
4,167,291 A 9/1979 Ridley
4,169,506 A 10/1979 Berry
4,176,882 A 12/1979 Studebaker et al.
4,181,177 A 1/1980 Compton
4,184,547 A 1/1980 Klass et al.
4,189,376 A 2/1980 Mitchell
4,191,251 A 3/1980 Cha
4,192,381 A 3/1980 Cha
4,192,552 A 3/1980 Cha
4,193,451 A 3/1980 Dauphine
4,202,412 A 5/1980 Ruskin
4,218,309 A 8/1980 Compton
4,227,574 A 10/1980 Cha
4,239,283 A 12/1980 Ridley
4,239,284 A 12/1980 Ridley et al.
4,243,100 A 1/1981 Cha
4,246,965 A 1/1981 Cha
4,265,307 A 5/1981 Elkins
RE30,738 E 9/1981 Bridges et al.
4,324,292 A 4/1982 Jacobs et al.
4,328,863 A 5/1982 Berry
4,359,246 A 11/1982 Ricketts
4,366,986 A 1/1983 Bohn et al.
4,374,545 A 2/1983 Bullen et al.
4,376,034 A 3/1983 Wall
4,378,949 A 4/1983 Miller
4,379,591 A 4/1983 Tassoney
4,379,593 A 4/1983 Weichman
4,384,614 A 5/1983 Justheim
4,389,300 A 6/1983 Mitchell
4,396,491 A 8/1983 Stiller et al.
4,401,162 A 8/1983 Osborne
4,401,163 A 8/1983 Elkins
4,401,551 A 8/1983 Mitchell
4,408,665 A 10/1983 Dougan
4,423,907 A 1/1984 Ridley
4,424,121 A 1/1984 Choi et al.
4,425,220 A 1/1984 Kestner
4,425,967 A 1/1984 Hoekstra
4,435,016 A 3/1984 Wissenberg et al.
4,436,344 A 3/1984 Forgac et al.
4,437,519 A 3/1984 Cha et al.
4,441,985 A 4/1984 Burchfield et al.
4,444,258 A 4/1984 Kalmar
4,449,586 A 5/1984 Urban et al.
4,452,689 A 6/1984 Russum
4,454,915 A 6/1984 York et al.

(56) References Cited

U.S. PATENT DOCUMENTS 4,457,365 A 7/1984 Kasevich et al.
4,457,374 A 7/1984 Hoekstra et al.
4,458,757 A 7/1984 Bock et al.
4,458,944 A 7/1984 Fernandes
4,470,459 A 9/1984 Copland
4,481,099 A 11/1984 Mitchell
4,483,398 A 11/1984 Peters et al.
4,485,869 A 12/1984 Sresty et al.
4,487,260 A 12/1984 Pittman et al.
4,491,514 A 1/1985 Siskin et al.
4,495,056 A 1/1985 Venardos et al.
4,502,942 A 3/1985 Lee et al.
4,531,783 A 7/1985 Ricketts
4,532,991 A 8/1985 Hoekstra et al.
4,533,181 A 8/1985 Ricketts
4,552,214 A 11/1985 Forgac et al.
4,595,056 A 6/1986 Zahradnik et al.
4,637,464 A 1/1987 Forgac et al.
4,640,352 A 2/1987 Vanmeurs et al.
4,691,773 A 9/1987 Ward et al.
4,695,373 A 9/1987 Ho
4,698,149 A 10/1987 Mitchell
4,703,798 A 11/1987 Friedman
4,705,108 A 11/1987 Little et al.
4,718,439 A 1/1988 Gorra et al.
4,737,267 A 4/1988 Pao et al.
4,798,668 A 1/1989 Ho
4,856,587 A 8/1989 Nielson
4,856,589 A 8/1989 Kuhlman et al.
4,886,118 A 12/1989 Van Meurs et al.
4,888,031 A 12/1989 Martens
4,895,206 A 1/1990 Price
4,926,941 A 5/1990 Glandt et al.
5,020,596 A 6/1991 Hemsath
5,058,675 A 10/1991 Travis
5,060,726 A 10/1991 Glandt et al.
5,091,076 A 2/1992 So
5,236,039 A 8/1993 Edelstein et al.
5,255,742 A 10/1993 Mikus
5,297,626 A 3/1994 Vinegar et al.
5,338,442 A 8/1994 Siskin et al.
5,404,952 A 4/1995 Vinegar et al.
5,411,089 A 5/1995 Vinegar et al.
5,433,271 A 7/1995 Vinegar et al.
5,843,311 A 12/1998 Richter et al.
6,056,057 A 5/2000 Vinegar et al.
6,079,499 A 6/2000 Mikus et al.
6,102,122 A 8/2000 de Rouffignac
6,279,653 B1 8/2001 Wegener et al.
6,547,957 B1 4/2003 Sudhakar et al.
6,702,016 B2 3/2004 de Rouffignac et al.
6,715,549 B2 4/2004 Wellington et al.
6,719,047 B2 4/2004 Fowler et al.
6,722,431 B2 4/2004 Karanikas et al.
6,729,395 B2 5/2004 Shahin, Jr. et al.
6,769,483 B2 8/2004 de Rouffignac et al.
6,769,486 B2 8/2004 Lim et al.
6,782,947 B2 8/2004 de Rouffignac et al.
6,877,555 B2 4/2005 Karanikas et al.
6,880,633 B2 4/2005 Wellington et al.
6,889,769 B2 5/2005 Wellington et al.
6,896,053 B2 5/2005 Berchenko et al.
6,902,004 B2 6/2005 de Rouffignac et al.
6,915,850 B2 7/2005 Vinegar et al.
6,918,442 B2 7/2005 Wellington et al.
6,923,257 B2 8/2005 Wellington et al.
6,932,155 B2 8/2005 Vinegar et al.
6,951,247 B2 10/2005 de Rouffignac et al.
6,951,248 B2 10/2005 Conaway et al.
6,953,087 B2 10/2005 de Rouffignac et al.
6,964,300 B2 11/2005 Vinegar et al.
6,991,032 B2 1/2006 Berchenko
6,991,033 B2 1/2006 Wellington et al.
6,991,036 B2 1/2006 Sumnu-Dindoruk et al.
6,994,160 B2 2/2006 Wellington et al.
6,994,169 B2 2/2006 Zhang et al.
6,997,518 B2 2/2006 Vinegar et al.
7,004,251 B2 2/2006 Ward et al.
7,011,154 B2 3/2006 Maher et al.
7,013,972 B2 3/2006 Vinegar et al.
7,032,660 B2 4/2006 Vinegar et al.
7,051,811 B2 5/2006 de Rouffignac et al.
7,055,600 B2 6/2006 Messier et al.
7,073,578 B2 7/2006 Vinegar et al.
7,077,198 B2 7/2006 Vinegar et al.
7,086,465 B2 8/2006 Wellington et al.
7,090,013 B2 8/2006 Wellington
7,091,460 B2 8/2006 Kinzer
7,096,942 B1 8/2006 de Rouffignac et al.
7,100,994 B2 9/2006 Vinegar et al.
7,114,566 B2 10/2006 Vinegar et al.
7,121,342 B2 10/2006 Vinegar et al.
7,344,889 B2 3/2008 Kelemen et al.
7,416,022 B2 8/2008 Maguire
7,441,603 B2 10/2008 Kaminsky et al.
7,484,561 B2 2/2009 Bridges
7,500,517 B2 3/2009 Looney et al.
7,510,000 B2 3/2009 Pastor-Sanz et al.
7,540,324 B2 6/2009 de Rouffignac et al.
7,543,638 B2 6/2009 Goodman
7,549,470 B2 6/2009 Vinegar et al.
7,556,096 B2 7/2009 Vinegar et al.
7,559,368 B2 7/2009 Vinegar et al.
7,562,707 B2 7/2009 Miller
7,584,789 B2 9/2009 Mo et al.
7,604,052 B2 10/2009 Roes et al.
7,631,690 B2 12/2009 Vinegar et al.
7,635,023 B2 12/2009 Goldberg et al.
7,669,657 B2 3/2010 Symington et al.
7,712,528 B2 5/2010 Langdon et al.
7,735,935 B2 6/2010 Vinegar et al.
7,789,164 B2 9/2010 Looney et al.
7,841,407 B2 11/2010 Wellington et al.
7,841,408 B2 11/2010 Vinegar
7,845,411 B2 12/2010 Vinegar et al.
7,849,922 B2 12/2010 Vinegar et al.
7,857,056 B2 12/2010 Kaminsky et al.
7,862,705 B2 1/2011 Dana et al.
7,866,386 B2 1/2011 Beer et al.
7,906,014 B2 3/2011 Dana et al.
7,942,203 B2 5/2011 Vinegar et al.
7,950,453 B2 5/2011 Farmayan et al.
7,967,974 B2 6/2011 Dana et al.
7,980,312 B1 7/2011 Hill et al.
2002/0029882 A1 3/2002 Rouffignac et al.
2002/0033253 A1 3/2002 Rouffignac et al.
2002/0033256 A1 3/2002 Wellington et al.
2002/0033257 A1 3/2002 Shahin, Jr. et al.
2002/0036084 A1 3/2002 Vinegar et al.
2002/0036089 A1 3/2002 Vinegar et al.
2002/0038705 A1 4/2002 Wellington et al.
2002/0038709 A1 4/2002 Wellington et al.
2002/0038710 A1 4/2002 Maher et al.
2002/0038711 A1 4/2002 de Rouffignac et al.
2002/0040173 A1 4/2002 de Rouffignac et al.
2002/0040778 A1 4/2002 Wellington et al.
2002/0040779 A1 4/2002 Wellington et al.
2002/0040780 A1 4/2002 Wellington et al.
2002/0040781 A1 4/2002 Keedy et al.
2002/0045553 A1 4/2002 Vinegar et al.
2002/0046832 A1 4/2002 Zhang et al.
2002/0046837 A1 4/2002 Wellington et al.
2002/0046838 A1 4/2002 Karanikas et al.
2002/0049360 A1 4/2002 Wellington et al.
2002/0050352 A1 5/2002 Wellington et al.
2002/0050357 A1 5/2002 Wellington et al.
2002/0052297 A1 5/2002 de Rouffignac et al.
2002/0053429 A1 5/2002 Stegemeier et al.
2002/0053431 A1 5/2002 Wellington et al.
2002/0053435 A1 5/2002 Vinegar et al.
2002/0056551 A1 5/2002 Wellington et al.
2002/0056552 A1 5/2002 Wellington et al.
2002/0057905 A1 5/2002 Wellington et al.
2002/0062052 A1 5/2002 de Rouffignac et al.

(56) References Cited

U.S. PATENT DOCUMENTS

| | | | |
|---|---|---|---|
| 2002/0062961 | A1 | 5/2002 | Vinegar et al. |
| 2002/0066565 | A1 | 6/2002 | de Rouffignac et al. |
| 2002/0076212 | A1 | 6/2002 | Zhang et al. |
| 2002/0084074 | A1 | 7/2002 | de Rouffignac et al. |
| 2002/0096320 | A1 | 7/2002 | Wellington et al. |
| 2003/0040441 | A1 | 2/2003 | Miller et al. |
| 2003/0062164 | A1 | 4/2003 | Wellington et al. |
| 2003/0079877 | A1 | 5/2003 | Wellington et al. |
| 2003/0098149 | A1 | 5/2003 | Wellington et al. |
| 2003/0098605 | A1 | 5/2003 | Vinegar et al. |
| 2003/0102125 | A1 | 6/2003 | Wellington et al. |
| 2003/0102130 | A1 | 6/2003 | Vinegar et al. |
| 2003/0116315 | A1 | 6/2003 | Wellington et al. |
| 2003/0130136 | A1 | 7/2003 | de Rouffignac et al. |
| 2003/0137181 | A1 | 7/2003 | Wellington et al. |
| 2003/0141067 | A1 | 7/2003 | de Rouffignac et al. |
| 2003/0142964 | A1 | 7/2003 | Wellington et al. |
| 2003/0146002 | A1 | 8/2003 | Vinegar et al. |
| 2003/0155111 | A1 | 8/2003 | Vinegar et al. |
| 2003/0173072 | A1 | 9/2003 | Vinegar et al. |
| 2003/0173080 | A1 | 9/2003 | Berchenko et al. |
| 2003/0173081 | A1 | 9/2003 | Vinegar et al. |
| 2003/0173082 | A1 | 9/2003 | Vinegar et al. |
| 2003/0183390 | A1 | 10/2003 | Veenstra et al. |
| 2003/0196789 | A1 | 10/2003 | Wellington et al. |
| 2003/0196810 | A1 | 10/2003 | Vinegar et al. |
| 2003/0201098 | A1 | 10/2003 | Karanikas et al. |
| 2003/0205378 | A1 | 11/2003 | Wellington et al. |
| 2003/0213594 | A1 | 11/2003 | Wellington et al. |
| 2004/0015023 | A1 | 1/2004 | Wellington et al. |
| 2004/0020642 | A1 | 2/2004 | Vinegar et al. |
| 2004/0149433 | A1 | 8/2004 | McQueen |
| 2005/0252656 | A1 | 11/2005 | Maguire |
| 2005/0269091 | A1 | 12/2005 | Pastor-Sanz et al. |
| 2007/0012598 | A1 | 1/2007 | Rendall |
| 2007/0023186 | A1 | 2/2007 | Kaminsky et al. |
| 2007/0193743 | A1 | 8/2007 | Harris et al. |
| 2007/0209799 | A1 | 9/2007 | Vinegar et al. |
| 2007/0221377 | A1 | 9/2007 | Vinegar et al. |
| 2007/0284107 | A1 | 12/2007 | Crichlow |
| 2008/0006410 | A1 | 1/2008 | Looney et al. |
| 2008/0017549 | A1 | 1/2008 | Kennel et al. |
| 2008/0023197 | A1 | 1/2008 | Shurtleff |
| 2008/0059140 | A1 | 3/2008 | Salmon et al. |
| 2008/0087427 | A1 | 4/2008 | Kaminsky et al. |
| 2008/0087428 | A1 | 4/2008 | Symington et al. |
| 2008/0116694 | A1 | 5/2008 | Hendershot |
| 2008/0164030 | A1 | 7/2008 | Young |
| 2008/0173450 | A1 | 7/2008 | Goldberg et al. |
| 2008/0207970 | A1 | 8/2008 | Meurer et al. |
| 2008/0257552 | A1 | 10/2008 | Shurtleff et al. |
| 2008/0283241 | A1 | 11/2008 | Kaminsky et al. |
| 2008/0290719 | A1 | 11/2008 | Kaminsky et al. |
| 2008/0314593 | A1 | 12/2008 | Vinegar et al. |
| 2009/0014179 | A1 | 1/2009 | Mango |
| 2009/0014181 | A1 | 1/2009 | Vinegar et al. |
| 2009/0050319 | A1 | 2/2009 | Kaminsky et al. |
| 2009/0078415 | A1 | 3/2009 | Fan et al. |
| 2009/0101346 | A1 | 4/2009 | Vinegar et al. |
| 2009/0133935 | A1 | 5/2009 | Kinkead |
| 2009/0200022 | A1 | 8/2009 | Bravo et al. |
| 2009/0200023 | A1 | 8/2009 | Costello et al. |
| 2009/0242196 | A1 | 10/2009 | Pao |
| 2009/0250381 | A1 | 10/2009 | Fan et al. |
| 2009/0313772 | A1 | 12/2009 | Talley |
| 2010/0032171 | A1 | 2/2010 | Bali et al. |
| 2010/0056404 | A1 | 3/2010 | Talley |
| 2010/0126727 | A1 | 5/2010 | Vinegar et al. |
| 2010/0173806 | A1 | 7/2010 | Fan et al. |
| 2010/0200232 | A1 | 8/2010 | Langdon et al. |
| 2010/0200234 | A1 | 8/2010 | Mango |
| 2010/0218945 | A1 | 9/2010 | Sadok |
| 2010/0270015 | A1 | 10/2010 | Vinegar et al. |
| 2010/0270038 | A1 | 10/2010 | Looney et al. |
| 2010/0282460 | A1 | 11/2010 | Stone et al. |
| 2010/0319909 | A1 | 12/2010 | Symington et al. |
| 2011/0000825 | A1 | 1/2011 | McGrady et al. |
| 2011/0049016 | A1 | 3/2011 | McGrady et al. |
| 2011/0088904 | A1 | 4/2011 | de Rouffignac et al. |
| 2011/0146982 | A1 | 6/2011 | Kaminsky et al. |
| 2011/0174496 | A1 | 7/2011 | Burnham et al. |
| 2011/0180262 | A1 | 7/2011 | O'Dowd |
| 2011/0186296 | A1 | 8/2011 | Cassidy |
| 2011/0290490 | A1 | 12/2011 | Kaminsky et al. |
| 2011/0303413 | A1 | 12/2011 | Fairbanks et al. |

OTHER PUBLICATIONS

Parkash, S, Refining Processes Handbook, 2003, Gulf Publishing, pp. 1-28.*

Murphy, M, Perhydro-beta-Carotene in Green River Shale, Science, 1967, vol. 157, pp. 1040-1042.*

U.S. Appl. No. 13/335,409, filed Dec. 22, 2011, entitled "In-Situ Kerogen Conversion and Recovery".

U.S. Appl. No. 13/335,525, filed Dec. 22, 2011, entitled "In-Situ Kerogen Conversion and Product Isolation".

U.S. Appl. No. 13/335,607, filed Dec. 22, 2011, entitled "In-Situ Kerogen Conversion and Product Upgrading".

U.S. Appl. No. 13/335,673, filed Dec. 22, 2011, entitled "In-Situ Kerogen Conversion and Recycling".

U.S. Appl. No. 13/335,195, filed Dec. 22, 2011, entitled "Preconditioning a Subsurface Shale by Removing Extractable Organics".

U.S. Appl. No. 13/335,290, filed Dec. 22, 2011, entitled "Preparation and Use of Nano-Catalyst for in Situ Reaction with Kerogen".

U.S. Appl. No. 13/335,864, filed Dec. 22, 2011, entitled "Kerogen Conversion in a Subsurface Shale Formation with Oxidant Regeneration".

U.S. Appl. No. 13/335,907, filed Dec. 22, 2011, entitled "Electrokinetic Enhanced Hydrocarbon Recovery from Oil Shale".

U.S. Appl. No. 13/491,925, filed Jun. 8, 2012, entitled "Soluble Acids from Naturally Occurring Aqueous Streams".

US 6,595,286, 7/2003, Fowler et al. (withdrawn).

Vandenbrouck, M. et al., "Kerogen origin, evolution and structure", *Organic Geochemistry* 38:719-833 (2007).

Philp, R.P. et al., "Saponification of the Insoluble Organic Residues from Oil Shales, Algal Oozes, and Algae", *Energy Sources* 4(2): 113-123 (1978).

Huseby, B. and Ocampo, R, "Evidence for porphyrins bound, via ester bonds, to the Messel oil shale kerogen by selective chemical degradation experiments", *Geochimica et Cosmochimica Acta* 61(18):3951-3955 (1997).

Amblès, A., et al., "Ester- and ether bond cleavage in immature kerogens", *Org. Geochem* 24(6/7):681-690 (1996).

McGowan, C.W., et al., "A Comparison of the Dissolution of Model Compounds and the Kerogen of Green River Oil Shale by Oxidation with Perchloric Acid—A Model for the Kerogen of the Green River Oil Shale", *Fuel Processing Technology* 10:195-204 (1985).

McGowan, Chris W., "The Oxidation of Green River Oil Shale with Perchloric Acid—Part I—The Reaction of Green River Oil Shale with Perchloric of Varying Concentration and Boiling Point", *Fuel Processing Technology* 10:169-179 (1985).

McGowan, Chris W., et al., "The Role of Ether Oxygen and Carbon Double Bonds as Linkages During the Dissolution of Kerogens with Perchloric Acid" *ACS Fuel* 42(1):172-175 (Spring 1997).

Boucher, Raymond J., et al., "Molecular characterization of kerogens by mild selective chemical degradation—ruthenium tetroxide oxidation", *Fuel* 70:695-708 (1991).

Robinson, W.E., et al., "Constitution of Organic Acids Prepared from Colorado Oil Shale", *Industrial and Engineering Chemistry* 48(7):1134-1128 (1956).

Philp, R.P. and Yang, E., "Alkaline Potassium Permanganate Degradation of Insoluble Organic Residues (Kerogen) Isolated from Recently-Deposited Algal Mats" *Energy Sources* 3(2):149-161 (1997).

Robinson, W.E., et al., "Alkaline Permanganate Oxidation of Oil-Shale Kerogen", *Industrial and Engineering Chemistry* 45(4):788-791 (1953).

(56) References Cited

OTHER PUBLICATIONS

Djuricic, M., et al., "Organic acids obtained by alkaline permanganate oxidation of kerogen from the Green River (Colorado) shale", *Geochimica et Cosmochimica Acta* 35:1201-1207 (1971).
Young, D.K. and Yen, T.F., "The nature of straight-chain aliphatic sstructures in Green River kerogen", *Geochimica et Cosmochimica Acta* 41:1411-1417 (1977).
Amblès, A., et al., "Nature of Kerogen from Green River Shale based on the Charactyer of the Products of a Forty-Step Alkaline Permanganate Oxidation", *Adv. Org. Geochem* 554-560 (1981).
Vitorović, D., et al., "Improvement of kerogen structural interpretations based on oxidation products isolated from aqueous solutions", *Advances in Organic Geochemistry* 10:1119-1126 (1985).
Vitorović, D., et al., "Relationship between kerogens of various structural types and the products of their multistep oxidative degradation", *Org. Geochem*. 6:333-342 (1984).
Vitorović, D., et al., "The feasibilities of the alkaline permanganate degradation method for the characterization and classification of kerogens", *J. Serb. Chem. Soc.* 53(4):175-189 (1988).
Burlingame, A.L. and Simoneit, B.R., "High Resolution Mass Spectrometry of Green River Formation Kerogen Oxidations", *Nature* 222:741-747 (1969).
Simoneit, B.R., et al., "Sterochemical studies of acyclis isoprenoid compounds-V. Oxidation products of Green River Formation oil shale kerogen", *Geochimica et Cosmochimica Acta* 39:1143-1145 (1975).
Burlingame, A.L. and Simoneit, B.R., "Isoprenoid Fatty Acids Isolated from the Kerogen Matrix of the Green River Formation (Eocene)", *Science* 160:531-533 (1968).
Simoneit, B.R. and Burlingame, A.L., "Carboxylic acids derived from Tasmanian tasmanite by extractions and kerogen oxidations", *Geochimica et Cosmochimica Acta* 37:595-610 (1973).
Hayatsu, Ryoichi, et al., "Investigation of aqueous sodium dichromate oxidation for coal structural studies", *Fuel* 60:77-82 (1981).
Hayatsu, Ryoichi, et al., "Is kerogen-like material present in coal: 2. Chromic acid oxidation of coal and kerogen", *Fuel* 60:161-203 (1981).
Barakat, A.O. and Yen, T.F., "Distribution of Acyclic Isoprenoids in Fractions from Stepwise Oxidation of Greene River Kerogen", *Energy Sources* 10:253-259 ((1988).
Barakat, A.O., "Carboxylic Acids Obtained by Alkaline Hydrolysis of Monterey Kerogen", *Energy and Fuels* 7:988-993 (1993).
Barakat, Assem O., Size Distribution of the Straight-Chain Structures in Type I and II Kerogens, *Energy and Fuels* 2:181-185 (1988).
Barakat, A.O. and Yen, T.F., "Distribution of pentacyclic triterpenoids in Green River oil shale kerogen", *Org. Geochem*. 15(3):299-311 (1990).
Barakat, A.O. and Yen, T.F., "The Nature of Porphyrins in Kerogen. Evidence of Entrapped Etioporphyrin Species", *Energy & Fuels* 3:613-616 (1989).
Barakat, A.O. and Yen, T.F., "Novel Identification of 17β(H)-Hopanoids in Green River Oil Shale Kerogen", *Energy & Fuels* 2:105-108 (1988).
Barakat, Assem O. and Yen, Teh Fu, "Kerogen structure by stepwise oxidation; Use of sodium dichromate in glacial acetic acid", *Fuel* 66:587-753 (1987).

* cited by examiner

ISOLATING LUBRICATING OILS FROM SUBSURFACE SHALE FORMATIONS

RELATED APPLICATIONS

The subject application is related to U.S. Provisional Application Ser. No. 61/426,340, filed Dec. 22, 2010. This application is also related to U.S. application Ser. No. 13/335,409, entitled "In-Situ Kerogen Conversion and Recovery" filed Dec. 22, 2011; U.S. application Ser. No. 13/335,525, entitled "In-Situ Kerogen Conversion and Product Isolation" filed Dec. 22, 2011; U.S. application Ser. No. 13/335,607, entitled "In-Situ Kerogen Conversion and Upgrading" filed Dec. 22, 2011; U.S. application Ser. No. 13/335,673, entitled "In-Situ Kerogen Conversion and Recycling" filed Dec. 22, 2011, and U.S. application Ser. No. 13/335,195, entitled "Preconditioning a Subsurface Shale Formation by Removing Extractible Organics" filed Dec. 22, 2011. The contents of all of these related applications are incorporated herein by reference in their entirety.

BACKGROUND

If proponents of Hubbert peak theory are correct, world oil production will soon peak, if it has not done so already. Regardless, world energy consumption continues to rise at a rate that outpaces new oil discoveries. As a result, alternative sources of energy must be developed, as well as new technologies for maximizing the production and efficient consumption of oil. See T. Mast, Over a Barrel: A Simple Guide to the Oil Shortage, Greenleaf Book Group, Austin, Tex., 2005.

A particularly attractive alternative source of energy is oil shale, the attractiveness stemming primarily from the fact that oil can be "extracted" from the shale and subsequently refined in a manner much like that of crude oil. Technologies involving the extraction, however, must be further developed before oil shale becomes a commercially-viable source of energy. See J. T. Bartis et al, Oil Shale Development in the United States: Prospects and Policy Issues, RAND Corporation, Arlington, Va., 2005.

The largest known deposits of oil shale are found in the Green River Formation, which covers portions of Colorado, Utah, and Wyoming. Estimates on the amount of recoverable oil from the Green River Formation deposits are as high as 1.1 trillion barrels of oil—almost four times the proven oil reserves of Saudi Arabia. At current U.S. consumption levels (~20 million barrels per day), these shale deposits could sustain the U.S. for another 140 years (Bartis et al.) At the very least, such shale resources could moderate the price of oil and reduce U.S. dependence on foreign oil.

Oil shale typically consists of an inorganic component (primarily carbonaceous material, i.e., a carbonate), an organic component (kerogen) that can only be mobilized by breaking the chemical bonds in the kerogen, and frequently a second organic component (bitumen). Thermal treatment can be employed to break (i.e., "crack") the kerogen into smaller hydrocarbon chains or fragments, which are gas or liquids under retort conditions, and facilitate separation from the inorganic material. This thermal treatment of the kerogen is also known as "thermal upgrading" or "retorting," and can be done at either the surface or in situ, where in the latter case, the fluids so formed are subsequently transported to the surface.

In some applications of surface retorting, the oil shale is first mined or excavated, and once at the surface, the oil shale is crushed and then heated (retorted) to complete the process of transforming the oil shale to a crude oil—sometimes referred to as "shale oil." See, e.g., Shuman et al., U.S. Pat. No. 3,489,672. The crude oil is then shipped off to a refinery where it typically requires additional processing steps (beyond that of traditional crude oil) prior to making finished products such as gasoline, lubricant, etc. Note that various chemical upgrading treatments can also be performed on the shale prior to the retorting, See, e.g., So et al., U.S. Pat. No. 5,091,076.

A method for in situ retorting of carbonaceous deposits such as oil shale has been described in Kvapil et al., U.S. Pat. No. 4,162,808. In this method, shale is retorted in a series of rubblized in situ retorts using combustion (in air) of carbonaceous material as a source of heat.

The Shell Oil Company has been developing new methods that use electrical heating for the in situ upgrading of subsurface hydrocarbons, primarily in subsurface formations located approximately 200 miles (320 km) west of Denver, Colo. See, e.g., Vinegar et al., U.S. Pat. No. 7,121,342; and Berchenko et al., U.S. Pat. No. 6,991,032. In such methods, a heating element is lowered into a well and allowed to heat the kerogen over a period of approximately four years, slowly converting (upgrading) it into oils and gases, which are then pumped to the surface. To obtain even heating, 15 to 25 heating holes could be drilled per acre. Additionally, a ground-freezing technology to establish an underground barrier around the perimeter of the extraction zone is also envisioned to prevent groundwater from entering and the retorting products from leaving. While the establishment of "freeze walls" is an accepted practice in civil engineering, its application to oil shale recovery still has unknown environmental impacts. Additionally, the Shell approach is recognized as an energy intensive process and requires a long timeframe to establish production from the oil shale.

In view of the aforementioned limitations of the above methods, simpler and more cost-effective methods of recovering commercial products from a subsurface shale formation remain needed.

SUMMARY OF THE INVENTION

The present invention is directed to processes for isolating heavy saturated hydrocarbons from a subsurface shale formation comprising kerogen and an extractible organics component. These heavy saturated hydrocarbons comprise saturated beta-carotene. A heavy fraction comprising saturated beta-carotene can be isolated from the subsurface shale and then used as a low haze heavy base oil. Bright stock is an example of low haze heavy base oils provided by isolating the heavy saturated hydrocarbons comprising saturated beta carotene from a subsurface shale formation. Accordingly, disclosed herein is the use of a heavy fraction comprising saturated beta-carotene derived from a subsurface shale formation as a bright stock or a bright stock blending component.

In one embodiment a process for isolating heavy hydrocarbons comprising saturated beta carotene from a subsurface shale formation is provided. The process comprises (a) providing a first hydrocarbon solvent to the subsurface shale formation comprising kerogen and an extractible organics component; (b) at least partially solubilizing at least a portion of the extractible organics component in the first hydrocarbon solvent; (c) removing the first solvent containing the extractible organics component from the subsurface shale formation; and (d) isolating a heavy hydrocarbon fraction comprising saturated beta-carotene.

In another embodiment, the process for isolating heavy saturated hydrocarbons from a subsurface shale formation comprising kerogen and an extractible organics component comprises (a) providing a first hydrocarbon solvent to the subsurface shale formation comprising kerogen and an extractible organics component; (b) at least partially solubilizing at least a portion of the extractible organics component in the first hydrocarbon solvent; (c) removing the first solvent containing the extractible organics component from the subsurface shale formation; (d) providing a second solvent to the subsurface shale formation comprising kerogen and an extractible organics component; (e) at least partially solubilizing at least a portion of the first hydrocarbon solvent in the second solvent; (f) removing the second solvent containing the first hydrocarbon solvent from the subsurface shale formation; and (g) isolating a heavy hydrocarbon fraction comprising saturated beta-carotene from the first solvent.

Also described herein is a process for making a bright stock. The process comprises (a) providing a first hydrocarbon solvent to the subsurface shale formation comprising kerogen and an extractible organics component; (b) at least partially solubilizing at least a portion of the extractible organics component in the first hydrocarbon solvent; (c) removing the first solvent containing the extractible organics component from the subsurface shale formation; (d) isolating a heavy hydrocarbon fraction comprising saturated beta-carotene from the first solvent; and (e) providing the heavy fraction comprising saturated beta-carotene as a bright stock. In some embodiments, two solvents may be used to solubilize the extractible organics component from the subsurface shale formation and provide the bright stock comprising saturated beta-carotene.

Further described herein is a process for making a blended bright stock. The process comprises (a) providing a first hydrocarbon solvent to the subsurface shale formation comprising kerogen and an extractible organics component; (b) at least partially solubilizing at least a portion of the extractible organics component in the first hydrocarbon solvent; (c) removing the first solvent containing the extractible organics component from the subsurface shale formation; (d) isolating a heavy hydrocarbon fraction comprising saturated beta-carotene from the first solvent; (e) providing the heavy fraction comprising saturated beta-carotene as a bright stock blending component; (f) blending the bright stock blending component with a petroleum derived bright stock or a Fischer-Tropsch derived bright stock; and (g) isolating a blended bright stock. In some embodiments, two solvents may be used to solubilize the extractible organics component from the subsurface shale formation and provide the bright stock blending component.

In some embodiments, a blended bright stock base oil is provided. The blended bright stock base oil comprises a heavy fraction comprising saturated beta-carotene derived from a subsurface shale formation and petroleum derived bright stock or a Fischer-Tropsch derived bright stock. A finished bright stock lubricant may also comprise an effective amount of at least one additive.

Among other factors, these processes are based on the discovery that the extractible organics component of a subsurface shale formation can be recovered and from the extractible organics component, a heavy hydrocarbon fraction comprising saturated beta-carotene can be isolated. The saturated beta-carotene product is a commercially valuable product. The saturated beta-carotene can be isolated and provided as a bright stock product. The subsurface shale formation is a previously unrecognized source for this product. As such, the presently disclosed processes advantageously provide a saturated beta-carotene product from a natural source. The presently disclosed processes are more environmentally benign, more economical, and more efficient in producing commercial products from shale.

DETAILED DESCRIPTION OF THE INVENTION

Introduction

Figure 1:
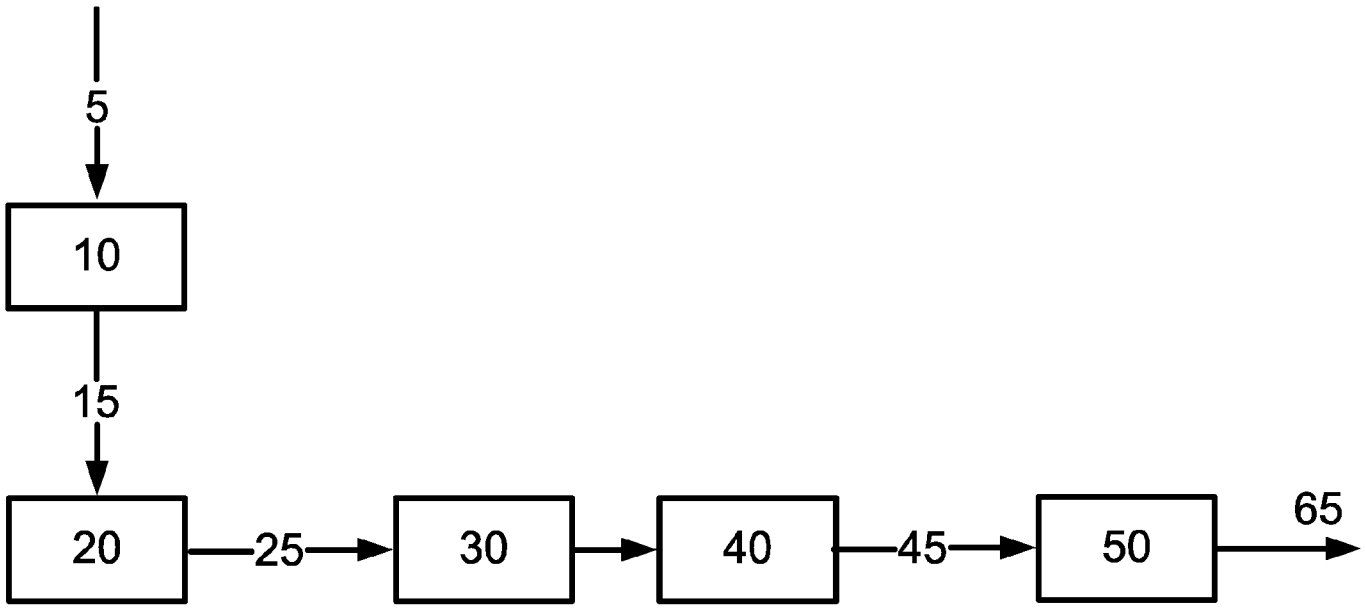
FIG. 1 is a block diagram illustrating an exemplary process for isolating heavy saturated hydrocarbons comprising saturated beta-carotene from a subsurface shale formation and providing a bright stock product using a first hydrocarbon solvent as disclosed herein.

Subsurface shale formations contain kerogen and an extractible organics component in an inorganic matrix. It has been surprisingly discovered that a heavy hydrocarbon fraction comprising saturated beta-carotene can be isolated from the extractible organics component. The heavy fraction contains a surprising large weight percentage of saturated beta-carotene. This heavy fraction comprising saturated beta-carotene can be used as a low haze heavy base oil, in particular as a bright stock or a bright stock blending component.

The extractible organics component is at least partially soluble in an organic solvent. In contrast, the kerogen is not soluble in organic solvent. The extractible organics can exist as an oily layer on the kerogen and can be removed by the processes disclosed herein. From this component, a saturated beta-carotene product can be obtained. Also, removal of the extractible organics increases the accessible surface area of the kerogen and makes the kerogen more accessible to fluids and catalysts.

The heavy hydrocarbon fraction comprising saturated beta-carotene can be isolated from the extracted organics component by a distillation process. The heavy hydrocarbons comprising saturated beta-carotene can be isolated as a 900° F.+ fraction. In certain embodiments, this product can be isolated as a 900-1005° F. fraction. In other embodiments, the product is isolated as a 930-955° F. fraction. The heavy fraction comprising saturated beta-carotene can also be isolated by HPLC. The saturated beta-carotene is a valuable commercial product.

Kerogen is also a valuable product. Kerogen is particularly attractive as an alternative source of hydrocarbons for energy. The present methods also make the kerogen more accessible to fluids and catalysts, and as such, kerogen derived hydrocarbonaceous products can be more readily removed from the subsurface shale formation. After removal of extractible organics, the kerogen can be more readily accessed for removal using methods including thermal treatments or heating.

After removal of extractible organics, the kerogen can also be upgraded in-situ creating mobile kerogen based products as described in U.S. application Ser. No. 13/335,409, entitled "In-Situ Kerogen Conversion and Recovery" filed Dec. 22, 2011; U.S. application Ser. No. 13/335,525, entitled "In-Situ Kerogen Conversion and Product Isolation" filed Dec. 22, 2011; U.S. application Ser. No. 13/335,607, entitled "In-Situ Kerogen Conversion and Upgrading" filed Dec. 22, 2011; U.S. application Ser. No. 13/335,673, entitled "In-Situ Kerogen Conversion and Recycling" filed Dec. 22, 2011, and U.S. application Ser. No. 13/335,290, entitled "Preparation and Use of Nano-Catalysts for In-Situ Reaction with Kerogen" filed Dec. 22, 2011. The contents of all of these applications are incorporated herein by reference in their entirety. Therefore, the present processes also have value in providing access to the kerogen. Removing at least a portion of the extractible organics component makes these processes for obtaining hydrocarbons from kerogen more efficient and higher yielding.

The present invention is directed to processes for isolating heavy saturated hydrocarbons comprising saturated beta-carotene from a subsurface shale formation by removing at least a portion of the extractible organics component and isolating a heavy hydrocarbon fraction comprising saturated beta-carotene. The heavy hydrocarbon fraction comprising saturated beta-carotene is a valuable commercial product. Saturated beta-carotene is a heavy, viscous oil that falls in the heavy base oil range. The heavy fraction comprising saturated beta-carotene can be used as a bright stock or a bright stock blending component. Accordingly, the present invention is also directed to processes for providing a bright stock and a bright stock blending component.

The present methods utilize in-situ extraction of the extractible organics component using liquid phase chemistry at ambient temperatures and pressures for the subsurface shale formation. The present methods utilize this in-situ extraction to provide a valuable commercial bright stock product containing saturated beta-carotene. The processes described herein are more environmentally benign, more economical, and more efficient in producing a valuable commercial bright stock product.

Definitions

In accordance with this detailed description, the following abbreviations and definitions apply. It must be noted that as used herein, the singular forms "a", "an", and "the" include plural referents unless the context clearly dictates otherwise. Thus, for example, reference to "a hydrocarbon solvent" includes a plurality of such.

As used herein, the terms "hydrocarbon" or "hydrocarbonaceous" or "petroleum" are used interchangeably to refer to material originating from oil shale, coal, tar sands, crude oil, natural gas or biological processes. Carbon and hydrogen are major components of hydrocarbons; minor components, such as oxygen, sulfur and nitrogen may also occur in some hydrocarbons. The hydrocarbon fraction includes both aliphatic and aromatic components. The aliphatic component can further be divided into acyclic alkanes, referred to as paraffins, and cycloalkanes, referred to as naphthenes. A paraffin refers to a non-cyclic, linear (normal paraffin) or branched (isoparaffin) saturated hydrocarbon. For example, a $C_8$ paraffin is a non-cyclic, linear or branched hydrocarbon having 8 carbon atoms per molecule. Normal octane, methylheptane, dimethylhexane, and trimethylpentane are examples of $C_8$ paraffins. A paraffin-rich feed comprises at least 10 wt %, at least 20 wt % or even at least 30 wt % paraffins. For example, a $C_8$ rich paraffinic feedstock contains at least 10 wt % $C_8$ hydrocarbons.

The term "derived from a Fischer-Tropsch process" or "Fischer-Tropsch derived," means that the product, fraction, or feed originates from or is produced at some stage by a Fischer-Tropsch process.

The term "derived from petroleum" or "petroleum derived," means that the product, fraction, or blending stock originates from or is produced at some stage from a petroleum-based source. Typical petroleum derived bright stock may be prepared from deasphalted oil, hydrocracked petroleum residuum stream, and heavy coker products.

As disclosed herein, boiling point temperatures are based on the ASTM D-2887 standard test method for boiling range distribution of petroleum fractions by gas chromatography, unless otherwise indicated. The mid-boiling point is defined as the 50% by volume boiling temperature, based on an ASTM D-2887 simulated distillation.

As disclosed herein, carbon number values (i.e., $C_5$, $C_6$, $C_8$, $C_9$ and the like) generally refers to a number of carbon atoms within a molecule. Carbon number ranges as disclosed herein (e.g., $C_8$ to $C_{12}$) refer to molecules having a carbon number within the indicated range (e.g., between 8 carbon and 12 carbon atoms), including the end members of the range. Likewise, an open ended carbon number range (e.g., $C_{35}$+) refers to molecules having a carbon number within the indicated range (e.g., 35 or more carbon atoms), including the end member of the range. As described herein, carbon number distributions are determined by true boiling point distribution and gas liquid chromatography.

The term "surface facility" as used herein is any structure, device, means, service, resource or feature that occurs, exists, takes place or is supported on the surface of the earth. The heavy hydrocarbon fraction comprising saturated beta-carotene generated in the process disclosed herein is isolated and recovered in surface facilities and further treated or transported.

"Shale," as defined herein, generally refers to "oil shale" and is a general term applied to a group of rocks rich enough in organic material (called kerogen) to yield petroleum upon pyrolysis and distillation. Such shale is generally subsurface and comprises an inorganic (usually carbonate) component or matrix in addition to the kerogen component.

A "subsurface shale formation," as defined herein, is an underground geological formation comprising (oil) shale. The subsurface shale formation comprises kerogen and an extractible organics component in an inorganic matrix.

A "low-permeability hydrocarbon-bearing formation," as defined herein, refers to formations having a permeability of less than about 10 millidarcies, wherein the formations comprise hydrocarbonaceous material. Examples of such formations include, but are not limited to, diatomite, coal, tight shales, tight sandstones, tight carbonates, and the like.

"Kerogen," as defined herein and as mentioned above, is an organic component of shale. On a molecular level, kerogen comprises very high molecular weight molecules that are generally insoluble by virtue of their high molecular weight and likely bonding to the inorganic component or matrix of the shale. In a geologic sense, kerogen is a precursor to crude oil. Kerogen is typically identified as being one of five types: Type I, Type II, Type II-sulfur, Type III, or Type IV, based on its C:H:O ratio and sulfur content, the various types generally being derived from different sources of ancient biological matter.

"Kerogen-based" and "kerogen-derived" are terms used herein to denote a molecular product or intermediate derived from kerogen, such derivation requiring a chemical modification of the kerogen, and the term being exclusive of derivations carried out over geologic timescales.

"Extractible organics" are organic components of the subsurface shale formation that are at least partially soluble in an organic solvent. In contrast, the kerogen is not soluble in organic solvent. This organic component that is at least partially soluble is referred to herein as "extractible organics". This extractible organic component includes what is commonly referred to as "bitumen". The extractable organic component is a solid or semi-solid material that is soluble or at least partially soluble in an organic solvent. As such, the extractable organic component can be removed by extraction using an organic solvent. Extraction of the extractible organic component makes the kerogen more accessible. It has been surprisingly discovered that the extractible organics component also provide valuable commercial products.

The term "low haze heavy base oil" means heavy hydrocarbons boiling above 800° F. and having a low pour and cloud point. As such the heavy base oil has few haze precursors and other impurities typically associated with a heavy base oil fraction. The low haze heavy base oil has a pour point less than 5° C. and in certain embodiments, less than 0° C. The low haze heavy base oil has a cloud point less than 10° C. and in certain embodiments, less than 5° C. Bright stock is an example of low haze heavy base oils.

The term "bright stock" means a heavy base oil having an initial boiling point of greater than 900° F. and a kinematic viscosity at 40° C. of greater than 180 cSt and in certain embodiments, greater than 200 cSt. Bright stocks are used in marine oils, monograde motor oils, gear oils, railroad engine oils, farm equipment oils, and greases.

The term "bright stock product" means a heavy base oil that independently meets the specifications for a bright stock and thus is independently a bright stock. It also includes heavy base oils that are used for blending with other heavy base oils to create a blended bright stock. As such, bright stock products include bright stocks and bright stock blending components.

The term "bright stock blending component" means a heavy base oil that is blended with other heavy base oils to create a blended bright stock. As such, a bright stock blending component is a base oil that is useful as a bright stock blending feedstock.

The term "saturated beta-carotene" means fully hydrogenated beta-carotene.

The term "aqueous fluid" as used herein refers to any water containing fluid, such as, municipal water; surface water, including from a lake, sea, ocean, river, and/or stream; formation water; water associated with industrial activity; or mixtures thereof.

The term "formation fluid" or "formation water" as used herein refers to the fluid, typically, water or aqueous fluid that is naturally occurring in a geological formation, such as the subsurface shale formation, or in a subsurface aquifer. The amount (or presence) of formation water in the formation, and the amount (or presence) of formation water in contact with the kerogen in the formation, depends on a number of factors, including the depth of the subsurface shale formation or the kerogen deposit that is within at least a portion of the subsurface shale formation. The naturally occurring formation water may contain dissolved alkali materials from naturally occurring deposits in the environment of the subsurface shale. In some cases, formation water is present in the formation prior to the start of the process for extracting a kerogen-based product from a subsurface shale formation.

A "surfactant" as used herein refers to any substance that reduces surface tension of a liquid, or reduces interfacial tension between two liquids, or between a liquid and a solid, or facilitates the dispersion of an organic material into an aqueous solution.

A "dense phase fluid," as defined herein, is a non-gaseous fluid. Such dense phase fluids include liquids and supercritical fluids (SCFs). The dense phase fluid can be any such fluid that suitably provides for increased accessibility of the kerogen to a fluid—typically due to fracturing and/or rubblizing of the shale in which the kerogen resides.

A "supercritical fluid" or a "fluid at supercritical conditions" as used herein, is any substance at a temperature and pressure above its thermodynamic critical point. Supercritical fluids can be regarded as "hybrid solvents" with properties between those of gases and liquids, i.e., a solvent with a low viscosity, high diffusion rates and no surface tension. The most common are carbon dioxide ($CO_2$) at supercritical conditions and water at supercritical conditions. For example, the critical temperature of $CO_2$ is 31.1° C., and the critical pressure of $CO_2$ is 72.9 atm (7.39 MPa).

The term "mechanical stress," as used herein, refers to structural stresses within the shale formation that result from pressure variations within the formation. Such stress can lead to fracturing and/or rubblization of the shale formation.

The term "thermal stress," as used herein, refers to structural stresses within the shale formation that result from thermal variations. Such thermal stresses can induce internal mechanical stresses as a result of differences in thermal coefficients of expansion among the various components of the shale formation. Like mechanical stress mentioned above, thermal stress can also lead to fracturing and/or rubblization of the shale formation.

The term "fracturing," as used herein, refers to the structural degradation of a subsurface shale formation as a result of applied thermal and/or mechanical stress. Such structural degradation generally enhances the permeability of the shale to fluids and increases the accessibility of the kerogen component to such fluids. The term "rubblization," as used herein, is a more extensive fracturing process yielding fracture planes in multiple directions that generate shale derived "rubble."

The term "cracking," as mentioned in the background section and as used herein, refers to the breaking of carbon-carbon bonds in the kerogen so as to yield species of lower molecular weight. "Retorting," provides thermal cracking of the kerogen. "Upgrading," provides cracking of the kerogen, but can involve a thermal or chemical upgrading agent. Accordingly, the term "thermal upgrading" is synonymous with the term "retorting."

The term "in situ," as used herein refers to the environment of the subsurface shale formation. The processes as disclosed herein involve in situ liquid phase extractions.

The term "commercial petroleum-based products," as used herein, refers to commercial products that include, but are not limited to, lubricants, heavy petrochemicals, and the like. Such products can also include blending feedstocks.

"Optional" or "optionally" means that the subsequently described event or circumstance may, but need not, occur, and that the description includes instances where the event or circumstance occurs and instances in which it does not.

The present invention is generally directed to methods for isolating heavy saturated hydrocarbons comprising saturated beta-carotene from a subsurface shale formation comprising kerogen and an extractible organics component in an inorganic matrix. The methods include the steps of providing a first hydrocarbon solvent to the subsurface shale formation comprising kerogen and an extractible organics component; at least partially solubilizing at least a portion of the extractible organics component in the first hydrocarbon solvent; removing the first solvent containing the extractible organics component from the subsurface shale formation; and isolating a heavy hydrocarbon fraction comprising saturated beta-carotene.

In certain embodiments, the methods comprise using one solvent, and in other embodiments two solvents are used. In embodiments in which two solvents are used, one solvent can be used primarily for solubilizing the extractible organics component and the second solvent can be used primarily for at least partially solubilizing and removing the first hydrocarbon solvent containing the extractible organics. As such, the second solvent can be used to assist in flushing the first solvent from the subsurface shale formation.

When two solvents are used, the solvents can be the same or different. In certain embodiments, the two solvents are different. In embodiments using two solvents, the methods comprise providing a first hydrocarbon solvent to the subsurface shale formation comprising kerogen and an extractible organics component; at least partially solubilizing at least a portion of the extractible organics component in the first hydrocarbon solvent; removing the first solvent containing the extractible organics component from the subsurface shale formation; providing a second solvent to the subsurface shale formation comprising kerogen and an extractible organics component; at least partially solubilizing at least a portion of the first hydrocarbon solvent in the second solvent; removing the second solvent containing the first hydrocarbon solvent from the subsurface shale formation; and isolating a heavy hydrocarbon fraction comprising saturated beta-carotene from the first solvent.

The methods rely on the extractible organics component being at least partially soluble in the hydrocarbon solvent. Among other factors, these processes are based on the discovery that the shale formation comprises both kerogen component and an extractible organics component. These processes are also based on the discovery that the extractible organics component includes a heavy hydrocarbon fraction comprising saturated beta-carotene. The heavy hydrocarbon fraction comprising saturated beta-carotene can be isolated as a valuable hydrocarbon product. Saturated beta-carotene is a heavy, viscous oil that falls in the heavy base oil range. Saturated beta-carotene has applications in lubricants as a bright stock and a bright stock blending component.

Removing at least a portion of the extractible organics also assists in making the kerogen more accessible for contacting with reactive fluids, catalysts, and heat treatments.

After extraction, the heavy hydrocarbon fraction comprising saturated beta-carotene is isolated. The heavy hydrocarbon fraction can be isolated by distillation or HPLC. Distillation and HPLC techniques are well known. The distillation is typically a vacuum distillation and the heavy hydrocarbon fraction comprising saturated beta-carotene is a 900° F.+ fraction. In certain embodiments, the fraction is a 900-1005° F. fraction. In other embodiments, the fraction is a 930-955° F. fraction.

The heavy hydrocarbon fraction comprising saturated beta-carotene product has a kinematic viscosity of 180 to 300 cSt at 40° C., a cloud point of less than −9° C., and a pour point of less than −9° C. In certain embodiments, the kinematic viscosity is 200 to 280 cSt at 40° C. In other embodiments, the kinematic viscosity is 200 to 260 cSt at 40° C. In embodiments, the kinematic viscosity at 100° C. is 15 to 20 cSt. In certain embodiments, the cloud point is less than −15° C., and the pour point is less than −15° C. In certain embodiments, the VI can be 60 to 100.

In particular, the heavy fraction comprising saturated beta-carotene is useful as a bight stock or a bright stock blending component. Accordingly, disclosed herein are processes for providing a bright stock processes for making a blended bright stock, and use of the heavy fraction comprising saturated beta-carotene as a bright stock or bright stock blending component.

The presently disclosed processes are more environmentally benign, more economical, and more efficient in producing commercial products and in providing access to kerogen.

The subsurface shale formation is accessed from the surface through at least one well. In general, the well will be cased, at least for a portion of its distance. Specifications for drilling access wells into a subsurface shale formation are known. In most applications of the invention, multiple wells will be provided into the subsurface shale formation, the well pattern based on recognized principles for this application. In some embodiments, a portion of the wells are employed as injection wells for passing solvents or fluids from the surface to the formation, and a portion of the wells are employed as production wells for withdrawing solvents or fluids from the formation to the surface. Each of the multiple wells may be used successively as an injection well and a production well, depending on the needs of the process. In an alternative, each well may be prepared and managed optimally as either an injection well or a production well. Specifications of each well for preparing and using the well as an injection well and/or a production well can readily be developed by one of skill in the art.

In the present methods, the hydrocarbon solvent may be provided and withdrawn using these wells. The hydrocarbon solvent can be any solvent in which the organics component is at least partially soluble. Suitable or exemplary solvents for extracting the extractible organics include 2-methyltetrahydrofuran, tetrahydrofuran, dichloromethane, chloroform, methanol, ethanol, acetone, carbon disulfide, benzene, toluene, xylene, pyridine, n-methyl-2-pyrrolidone (NMP), cyclopentyl methyl ether (CPME), ethyl lactate, dibasic esters (DBE), propylene carbonate, dimethyl carbonate, $CO_2$, $CO_2$ at supercritical conditions, and mixtures thereof. In certain embodiments, environmentally benign or green solvents are utilized.

Certain embodiments of the present methods involve using one hydrocarbon solvent, a first solvent, and certain embodiments involve using two hydrocarbon solvents, a first solvent and a second solvent. These solvents can be the same or different. In certain embodiments, the first solvent can be selected from the group consisting of 2-methyltetrahydrofuran, tetrahydrofuran, dichloromethane, chloroform, acetone, carbon disulfide, benzene, toluene, xylene, pyridine, n-methyl-2-pyrrolidone (NMP), cyclopentyl methyl ether (CPME), ethyl lactate, dibasic esters (DBE), propylene carbonate, dimethyl carbonate, $CO_2$, $CO_2$ at supercritical conditions, and mixtures thereof. In certain embodiments, the second solvent can be selected from the group consisting of methanol, ethanol, acetone, $CO_2$, $CO_2$ at supercritical conditions, and mixtures thereof. In some embodiments the second solvent is a fluid at supercritical conditions.

In one embodiment of the methods disclosed herein, the first solvent is 2-methyltetrahydrofuran and the second solvent is ethanol or $CO_2$ at supercritical conditions.

In the present methods, the solvent is provided to the formation and the extractible organics are absorbed into the solvent. The hydrocarbon solvent can be contacted with the extractible organics on the surface of the kerogen by circulating the solvent through the formation. Providing the solvent can generally be described as flowing the solvent through the formation, where it can be active (e.g., pumping) and/or passive. The solvent contacts the extractible organics component and at least a portion of the extractible organics component is dissolved or partially solubilized therein.

The step of extracting the organics component involves contacting the organics component with a hydrocarbon solvent and then removing the solvent containing the organics component from the subsurface shale formation. The step of extracting the organics component generally does not involve a chemical modification of the extractible organics component or the kerogen.

In the present methods, at least a portion of the extractible organics component is removed using the hydrocarbon solvent. After at least a portion of the extractible organics component is solubilized into the solvent, the solvent is removed from the formation. The step of removing the solvent containing the extractible organics component can generally be described as flowing the solvent containing the extractible organics component out of the subsurface formation, where it can be active (e.g., pumping) and/or passive.

The extractible organics can be isolated from the solvent at a surface facility. Product can be separated from the solvent flowing or pumped out of the formation using solvent extractions or by physical means, such as, for example, liquid-liquid separation, distillation, membrane separation, thermal separation processes, chromatography and the like. In one embodiment, the extractible organics component has a higher boiling point than the hydrocarbon solvent so the hydrocarbon solvent and extractible organics component can be separated based on these differing boiling points by distillation techniques, HPLC, and the like. The solvents can be recycled to the formation and re-circulated through the formation.

In the present processes, a heavy hydrocarbon fraction comprising saturated beta-carotene is isolated. The heavy hydrocarbon fraction comprising saturated beta-carotene can be isolated by distillation or HPLC. Distillation and HPLC techniques are well known to those of skill in the art. The distillation is typically a vacuum distillation and the heavy hydrocarbon fraction is a 900° F.+ fraction. In certain embodiments, the fraction is a 900-1005° F. fraction. In other embodiments, the fraction is a 930-955° F. fraction.

The heavy hydrocarbon fraction comprising saturated beta-carotene can be used as a bright stock or bright stock blending component without further modification or chemical treatments such as hydrocracking, isomerization, and the like. The fact that the heavy fraction comprising saturated beta-carotene can be used as a bright stock product without further modification is advantageous in providing an economical commercial product. Typical lubricant additives can be added to the heavy fraction comprising saturated beta-carotene to provide a commercial product.

In some embodiments, the above-described method may involve one or more additional steps which serve to sample and subsequently analyze the hydrocarbon solvent during the extraction process. Such sampling and analysis can have a direct bearing on the techniques employed in the subsequent steps. In certain embodiments, the first solvent can be analyzed for the extractible organics component. A predetermined content of extractible organics component can be set by one of ordinary skill in the art. As long as the first solvent contains the predetermined amount of extractible organics component or more, additional first solvent can be utilized to continue to remove extractible organics. When the amount of extractible organics component falls below the predetermined amount, extraction with the first solvent can be ceased.

As described, in certain embodiments two hydrocarbon solvents are utilized. When two solvents are used in the methods, the second solvent can be provided to the subsurface shale formation to remove at least a portion of the first hydrocarbon solvent from the subsurface shale formation and then the second solvent can be removed from the subsurface shale formation. When a second solvent is used, the first solvent should be miscible with the second solvent and the second solvent should be more miscible with the solvents to be used in the processes for mobilizing products from the kerogen. For example, typically the solvents used for mobilizing products from the kerogen are aqueous based or aqueous compatible. In these methods, the first solvent can be selected to best solubilize at least a portion of the extractible organics component and the second solvent can be chosen so that it is more compatible with the solvents for mobilizing a kerogen-based product. The extractible organics component may also be at least partially soluble in the second solvent. However, in certain embodiments, the second solvent is used primarily to solubilize and remove the first solvent containing extractible organics component, not to directly remove extractible organics component. Sampling and analysis of the first solvent can assist in determining when to switch from using the first solvent to the second solvent. In certain embodiments, when the amount of extractible organics component falls below the predetermined amount, extraction with the first solvent can be ceased and second solvent can be provided to the subsurface shale formation.

Embodiments using two solvents may be particularly useful in processes that are subsequently also going to include a process for producing kerogen from the subsurface shale formation. Methods for creating a mobile kerogen-based product are described in U.S. application Ser. No. 13/335,409, entitled "In-Situ Kerogen Conversion and Recovery" filed Dec. 22, 2011; U.S. application Ser. No. 13/335,525, entitled "In-Situ Kerogen Conversion and Product Isolation" filed Dec. 22, 2011; U.S. application Ser. No. 13/335,607, entitled "In-Situ Kerogen Conversion and Upgrading" filed Dec. 22, 2011; U.S. application Ser. No. 13/335,673, entitled "In-Situ Kerogen Conversion and Recycling" filed Dec. 22, 2011, and U.S. application Ser. No. 13/335,290, entitled "Preparation and Use of Nano-Catalysts for In-Situ Reaction with Kerogen" filed Dec. 22, 2011.

In embodiments using two solvents, the process comprises providing a first hydrocarbon solvent to the subsurface shale formation comprising kerogen and an extractible organics component; at least partially solubilizing at least a portion of the extractible organics component in the first hydrocarbon solvent; removing the first solvent containing the extractible organics component from the subsurface shale formation; providing a second solvent to the subsurface shale formation comprising kerogen and an extractible organics component; at least partially solubilizing at least a portion of the first hydrocarbon solvent in the second solvent; removing the second solvent containing the first hydrocarbon solvent from the subsurface shale formation; and isolating a heavy hydrocarbon fraction comprising saturated beta-carotene from the first solvent.

As described, the first solvent is chosen by one of ordinary skill in the art for solubilizing the extractible organics component and the second solvent is selected such that it is miscible with the first solvent and more compatible with the solvents for mobilizing a kerogen-based product. As such, the second solvent can be used to flush the first solvent from the formation.

The first solvent can be sampled and analyzed for the extractible organics component. Techniques for sampling and analysis are well known to one of ordinary skill in the art and can readily be selected. Analysis techniques include gas chromatography, mass spectrometry, and the like. Sampling and analysis can be used to assist in determining when to switch from using the first solvent to the second solvent. A predetermined content of extractible organics component can be set by one of ordinary skill in the art. As long as the first solvent contains the predetermined amount of extractible organics component or more, additional first solvent can be utilized to continue to remove the extractible organics component. When the amount of extractible organics component falls below the predetermined amount, extraction with the first solvent can be ceased and the second solvent can be provided to the formation. The second solvent can be used to solubilize and remove the first solvent from the formation.

A heavy hydrocarbon fraction comprising saturated beta-carotene is isolated. This heavy hydrocarbon fraction comprising saturated beta-carotene can be provided as a bright stock product without further modification.

After being withdrawn from the formation, the first and second solvents can be recycled to and recirculated through the subsurface formation so that less total volume of solvent is needed for the present methods.

The present methods utilize in-situ extraction of the extractible organics component using liquid phase chemistry at ambient temperatures and pressures for the subsurface shale formation. Providing the solvent and contacting it with the extractible organics component are generally conducted at or near natural formation temperature. In embodiments, providing the solvent and solubilizing the extractible organics component occurs at a temperature below pyrolysis temperature of the kerogen. In embodiments, this occurs at a temperature in the range of between 0° C. and 200° C. In one embodiment, this occurs at temperatures of 20° C. to 150° C. In some such embodiments, this occurs at a temperature in one of the following ranges: between 20° C. and 150° C.; between 20° C. and 100° C.; or between 25° C. and 75° C. As such, the present methods provide a bright stock product from a subsurface shale formation using liquid phase chemistry at ambient temperatures and pressures.

In a non-limiting specific example, providing the solvent and contacting it with the extractible organics component is conducted at a temperature of less than 50° C. above the natural formation temperature. The natural formation temperature, as used herein, is the temperature of the subsurface shale formation, in the region of the kerogen, prior to human intervention with or in the formation. Methods for determining a natural formation temperature are well known to those of skill in the art. Pyrolysis temperature, as used herein, is the temperature at which the kerogen thermally decomposes without the intervention of a catalytic or chemical agent. In the methods herein, the contacting occurs at a temperature below a pyrolysis temperature of the kerogen.

In some embodiments, the present methods are conducted under conditions in which no added heat is supplied to the formation fluid and/or to the subsurface shale in contact with the formation fluid. In some embodiments, if heat is supplied, it can be supplied by recirculating heating fluids. As such, no oxidative heating is used. The method as disclosed herein occurs at temperature below pyrolysis temperature of the kerogen.

Generally, the method is also conducted at or above natural formation pressure (i.e., the pressure of the subsurface shale formation in the region that includes the kerogen and extractible organics component). Methods for determining the formation pressure and the formation fracture pressure are known. In some such embodiments, the pressure can be up to 1000 psig; or up to 750 psig; or up to 500 psig; or even up to 250 psig above the initial formation pressure. The natural formation pressure, as used herein, is the pressure of the subsurface shale formation, in the region of the kerogen, prior to human intervention with or in the formation. Methods for determining a natural formation pressure are known.

Increasing Accessibility

The above-mentioned method may further comprise steps of increasing accessibility of the kerogen and the extractible organic component to the hydrocarbon solvent prior to providing the solvent to the subsurface shale. The step of increasing the accessibility of the subsurface shale may include a variety of techniques and/or technologies such as, but not limited to, explosive fracturing, hydraulic fracturing, thermal fracturing, propellants, and the like. Generally, any method of fracturing and/or rubblizing regions of the shale formation, so as to render the shale more permeable to fluids, is suitable. Such fracturing and/or rubblizing can also involve chemicals reactive to, e.g., at least part of the inorganic shale component.

In some embodiments, the step of increasing accessibility includes the sub-steps of: drilling a cased injection well into the subsurface shale formation comprising the subsurface shale; pressurizing the injection well with an aqueous fluid or water at pressures greater than the formation pressure, so as to create fractures and other voids in the formation.

In some embodiments, the step of increasing accessibility includes the sub-steps of: drilling a cased injection well into the subsurface shale formation comprising the subsurface shale; pressurizing and subsequently sealing the injection well with a dense phase fluid to provide a pressurized well; and rapidly de-pressurizing the pressurized well to reach a steady state reduced pressure. In some such embodiments, the sub-steps of pressurizing and de-pressurizing are repeated until an equilibrium pressure is reached.

The dense phase fluid can be any such fluid that suitably provides for increased accessibility of the kerogen and extractible organics component to a fluid or solvent—typically due to fracturing and/or rubblizing of the shale in which the kerogen and organic component resides. In some embodiments, the dense phase fluid comprises a component selected from the group consisting of carbon dioxide ($CO_2$), nitrogen ($N_2$), liquid natural gas (LNG), ammonia ($NH_3$), carbon monoxide (CO), argon (Ar), liquefied petroleum gas (LPG), hydrogen ($H_2$), hydrogen sulfide ($H_2S$), air, $C_1$ to $C_{20}$ hydrocarbons (including, but not limited to, ethane, propane, butane, and combinations thereof), and the like.

In some embodiments, the pressure in the pressurized well exceeds the fracture pressure of the subsurface shale formation. Such formation fracture pressure could be ascertained beforehand, for example—thereby helping to direct the choice of variable parameters used in this step.

In some embodiments, the dense phase fluid is absorbed by the kerogen and the kerogen subsequently swells, and wherein the swollen kerogen expands the subsurface shale formation and creates mechanical stresses leading to subsequent fracturing and/or rubblization of the formation. In some such embodiments, the mechanical stresses created during the pressurizing and depressurizing sub-steps enhance fracturing and/or rubblization of the subsurface shale formation.

In some embodiments, the pressurizing and depressurizing sub-steps create thermal and/or mechanical stresses in the subsurface shale formation. In some such embodiments, the kerogen at least partially delaminates from the inorganic component of the shale as a result of the thermal stresses.

In some embodiments, explosives are added to the dense phase fluid to enhance rubblization and fracturing of the formation. Examples of such explosives include, but are not limited to, strongly oxidizing species, nitro-containing species (e.g., trinitrotoluene, nitroglycerine), thermite mixtures, and the like. The dense phase fluids to which such explosives can be added include, but are not limited to, carbon dioxide ($CO_2$), nitrogen ($N_2$), liquid natural gas (LNG), ammonia ($NH_3$), carbon monoxide (CO), argon (Ar), liquefied petroleum gas (LPG), hydrogen ($H_2$), hydrogen sulfide ($H_{25}$), air, $C_1$ to $C_{20}$ hydrocarbons (including, but not limited to, ethane, propane, butane, and combinations thereof), and the like.

Preconditioning Treatments

The above-mentioned method also may also comprise preconditioning treatments. These treatments may include techniques such as, but not limited to, acidifying the inorganic matrix, oxidizing the kerogen, removing water from the formation, circulating a solvent to swell the kerogen, and combinations thereof. Generally, any method that makes the extractible organic component and/or kerogen more accessible is suitable.

According to the present methods, the subsurface shale formation can be preconditioned by any one, or a combination or all of the above described preconditioning processes. If a combination or all of the above described preconditioning processes are utilized, the preconditioning processes can be performed in any order desired. If a combination of preconditioning processes are utilized which involve the use of a solvent or fluid, the same solvent or fluid can advantageously be utilized for the various preconditioning treatments. For example, if a combination of acidifying the inorganic matrix and contacting the kerogen with a swelling agent are utilized, then ethanol, $CO_2$, $CO_2$ at supercritical conditions, or combinations thereof can advantageously be utilized for both preconditioning processes.

Heavy Hydrocarbon Fraction Comprising Saturated Beta-Carotene

The extractible organics component is removed from the formation (e.g., by flowing or pumping) and can be recovered. A heavy hydrocarbon fraction comprising saturated beta-carotene can be isolated from the solvents removed from the formation. The heavy hydrocarbon product can be separated from the solvent by distillation, extraction, HPLC, and/or other separation techniques at a surface facility. The heavy hydrocarbon fraction has a higher boiling point than the hydrocarbon solvent so the hydrocarbon solvent and heavy hydrocarbon fraction can be separated based on these differing boiling points by distillation techniques and the like. Fully saturated beta-carotene is the major component in the $C_{40}$, 900-1005° F. heavy fraction.

The isolated heavy hydrocarbon fraction comprises a significant amount of saturated beta carotene. In embodiments, the isolated heavy hydrocarbon fraction is primarily saturated beta carotene. The heavy hydrocarbon fraction contains over 50 weight % fully saturated hydrogenated beta-carotene. In certain embodiments, the heavy hydrocarbon fraction can contain over 70 weight % fully saturated hydrogenated beta-carotene. In other embodiments, the heavy hydrocarbon fraction can contain over 80 weight % fully saturated hydrogenated beta-carotene. In embodiments, the isolated heavy hydrocarbon fraction contains over 90 weight % fully saturated hydrogenated beta-carotene. In certain embodiments, the isolated heavy hydrocarbon fraction can be 99+ weight % fully saturated hydrogenated beta-carotene.

The extractible organics component may comprise other fully saturated biogenic hydrocarbons. For example the $C_{20}$ to $C_{30}$ fraction isolated is largely composed of a mixture of various fully saturated hydrocarbons of the sterane and hopane structural form. These products are also commercially useful.

The present processes provide a saturated beta-carotene product. While beta-carotene is a dark-red solid with a single stereochemical configuration, fully hydrogenated beta-carotene is a bright, clear, colorless oily liquid that includes many stereochemical forms, including many diastereomers. Simulated distillation shows fully hydrogenated beta-carotene boils in the 930-955° F. (Atmospheric Equivalent Boiling Point, AEBP) range, and is concentrated in the vacuum gas-oil refinery distillation cuts and can make-up over 50 weight percent on such cuts of a 2-MeTHF oil shale extract. Beta-carotene is a major product biosynthesized by certain algae, which can be used to produce biofuel. Fully saturated beta-carotene has applications as a heavy lubricating base oil. As described, the saturated beta-carotene product is useful as a bright stock lubricating base oil or a bright stock blending component.

The saturated beta-carotene product has a kinematic viscosity of 180 to 300 cSt at 40° C., a cloud point of less than −9° C., and a pour point of less than −9° C. In certain embodiments the cloud point is less than −15° C. and the pour point is less than −15° C. In certain embodiments, the kinematic viscosity is 200 to 280 cSt at 40° C. In other embodiments, the kinematic viscosity is 200 to 260 cSt at 40° C. In embodiments, the kinematic viscosity at 100° C. is 15 to 20 cSt. In embodiments the pour point is less than −20° C. In embodiments, the cloud point is than −20° C. In certain embodiments, the saturated beta-carotene can have a VI of 60 to 90.

The heavy hydrocarbon fraction comprising saturated beta-carotene can be isolated. The heavy fraction comprising saturated beta-carotene is useful as a bright stock or a bright stock blending component without further modification, such as hydrocracking, isomerization, and the like. Accordingly, the present processes are useful in providing a bright stock or bright stock blending component.

Typical lubricant additives optionally can be used in forming a finished bright stock lubricating product. Typical additives include extreme pressure additives, oxidation inhibitors, detergents, dispersants, foam inhibitors, pour point depressants, and the like.

In certain embodiments, the heavy fraction comprising saturated beta-carotene product can be provided as a bright stock blending feedstock or component and as such, blended with other lubricating base oils meeting specifications for bright stock, such as petroleum derived bright stock or Fischer-Tropsch derived bright stock. The bright stock products derived from subsurface shale formations may be blended with other lubricating base oils meeting specifications for bright stock to improve the properties of the final bright stock lubricant. For example, the bright stock products derived from subsurface shale formations may be used as a bright stock blending feedstock or component to improve the VI and/or kinematic viscosity at 100° C. of the final bright stock lubricant.

Petroleum derived bright stocks may be prepared from deasphalted oil, hydrocracked petroleum residuum, and heavy coker products. The saturated beta-carotene bright stock can be blended with the petroleum derived bright stock or Fischer Tropsch derived bright stock in an amount of 99 wt % to 10 wt %. In certain embodiments, the blended bright stock can be prepared by blending 75 to 25 wt % saturated beta-carotene bright stock derived from a subsurface shale formation with 75 to 25 wt % petroleum derived bright stock or Fischer Tropsch derived bright stock. Accordingly, the blended bright stock product comprises 99 to 10 wt % saturated beta-carotene bright stock derived from a subsurface shale formation and 90 to 1 wt % petroleum derived bright stock or Fischer Tropsch derived bright stock. In certain embodiments, the blended bright stock product comprises 75 to 25 wt % saturated beta-carotene bright stock derived from a subsurface shale formation and 75 to 25 wt % petroleum derived bright stock or Fischer Tropsch derived bright stock.

These bright stocks and bright stock blends can be used in marine oils, monograde motor oils, gear oils, railroad engine oils, farm equipment oils, and greases. In particular, the bright stocks prepared herein are suitable for uses without temperature dependence. The bright stocks are useful as oils in engines that continuously run and therefore are no subjected to varying temperatures.

The bright stock products comprising saturated beta-carotene have a VI of 60 to 100, a kinematic viscosity of 180 to 300 cSt at 40° C., a cloud point of less than −9° C., and a pour point of less than −9° C. In certain embodiments, the cloud point is less than −15° C. and the pour point is less than −15° C. In certain embodiments the VI is 60 to 90. In certain embodiments, the kinematic viscosity is 200 to 280 cSt at 40° C. In other embodiments, the kinematic viscosity is 200 to 260 cSt at 40° C. In embodiments, the kinematic viscosity at 100° C. is 15 to 20 cSt. In certain embodiments, the kinematic viscosity at 100° C. is greater than 24 cSt.

The products can be transported by pipeline or shipped in tankers, either by tanker or ship.

Exemplary Processes

In an exemplary process illustrated in FIG. 1, a first hydrocarbon solvent 5 is passed to the subsurface shale formation comprising kerogen and an extractible organics component in step 10 via a first (e.g., injection) well that has been drilled to penetrate the subsurface formation to provide access to the kerogen within the formation. In one embodiment, the subsurface shale formation has been fractured to enhance the permeability of the shale to the oxidant and to increase the accessibility of the kerogen component to this fluid.

The hydrocarbon solvent enters the subsurface shale formation as solvent 15 and contacts the kerogen and extractible organics present in the subsurface shale formation in step 20. In step 20 at least a portion of the extractible organics component is at least partially solubilized in the hydrocarbon solvent 25. The solvent containing the extractible organics component 25 is produced to the surface in step 30. In one embodiment, multiple fluid batches of hydrocarbon solvent are provided to the subsurface shale formation. The timing of each solvent addition depends, at least in part, on the progress of the solubilizing the extractible organics component and the content of extractible organics solubilized in the hydrocarbon solvent produced to the surface.

The solvent containing the extractible organics component produced at the surface is treated in step 40 for isolation and recovery of a heavy hydrocarbon fraction comprising saturated beta-carotene 45. Optionally, when the solvent containing extractible organics is treated and the heavy hydrocarbon fraction is isolated, solvent also can be isolated and then the solvent can be recycled to the process. In the illustrative process shown in FIG. 1, the heavy hydrocarbon fraction 45 isolated in step 40 is optionally blended with other bright stock lubricating base oils and/or additives in step 50. A commercial bright stock product 65 is provided.

Figure 2:
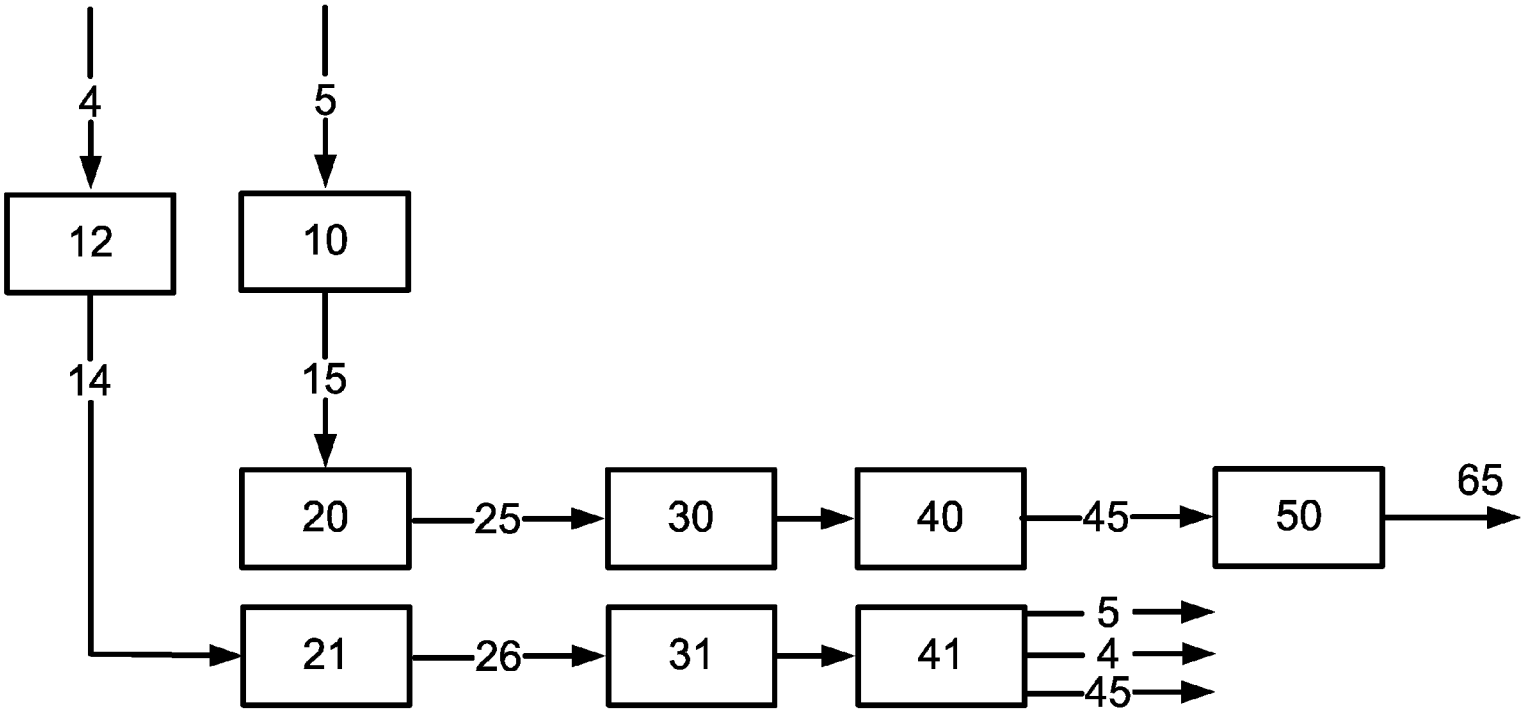
FIG. 2 is a block diagram illustrating an exemplary process for isolating heavy saturated hydrocarbons comprising saturated beta-carotene from a subsurface shale formation and providing a bright stock product using a first hydrocarbon solvent and a second solvent as disclosed herein.

An alternative exemplary process is illustrated in FIG. 2. In the exemplary process of FIG. 2, a first hydrocarbon solvent 5 is passed to the subsurface shale formation comprising kerogen and an extractible organics component in step 10 via a first (e.g., injection) well that has been drilled to penetrate the subsurface formation to provide access to the kerogen within the formation. In one embodiment, the subsurface shale formation has been fractured to enhance the permeability of the shale to the oxidant and to increase the accessibility of the kerogen component to this fluid.

The first hydrocarbon solvent enters the subsurface shale formation as solvent 15 and contacts the kerogen and extractible organics present in the subsurface shale formation in step 20. In step 20 at least a portion of the extractible organics component is at least partially solubilized in the first hydrocarbon solvent 25. The first hydrocarbon solvent containing the extractible organics component 25 is produced to the surface in step 30. In one embodiment, multiple fluid batches of first hydrocarbon solvent are provided to the subsurface shale formation. The timing of each solvent addition depends, at least in part, on the progress of the solubilizing the extractible organics component and the content of extractible organics solubilized in the hydrocarbon solvent produced to the surface.

The first hydrocarbon solvent containing the extractible organics component produced at the surface is treated in step 40 for isolation and recover of a heavy hydrocarbon fraction comprising saturated beta-carotene 45. Optionally, when the first hydrocarbon solvent containing extractible organics is treated and the heavy hydrocarbon fraction is isolated, solvent also can be isolated and then the solvent can be recycled to the process. In the illustrative process shown in FIG. 2, the heavy hydrocarbon fraction 45 isolated in step 40 is optionally blended with other bright stock lubricating base oils and/or additives in step 50. A commercial bright stock product 65 is provided.

When the amount of extractible organics component solubilized in the first solvent produced at the surface falls below a predetermined amount, addition of first hydrocarbon solvent 5 can be ceased. Sampling and analysis of the first solvent containing extractible organics component produced at the surface can be performed by techniques well known to those of skill in the art.

At a determined time, a second hydrocarbon solvent 4 is passed to the subsurface shale formation comprising kerogen and an extractible organics component in step 12 via a (e.g., injection) well that has been drilled to penetrate the subsurface formation to provide access to the kerogen within the formation. Two different injection wells (as illustrated) may be used or the same injection well may be used.

The second hydrocarbon solvent enters the subsurface shale formation as solvent 14 and contacts the kerogen, extractible organics present in the subsurface shale formation, and first hydrocarbon solvent present in the formation in step 21. In step 21 at least a portion of the first hydrocarbon solvent present in the formation is at least partially solubilized in the second hydrocarbon solvent 26. The second hydrocarbon solvent containing the first hydrocarbon solvent 26 is produced to the surface in step 31. In one embodiment, multiple fluid batches of second hydrocarbon solvent are provided to the subsurface shale formation. The timing of each solvent addition depends, at least in part, on the progress of the solubilizing the first solvent, the progress of solubilizing the extractible organics component, the content of first hydrocarbon solvent in the formation, and the content of extractible organics solubilized in the hydrocarbon solvent produced to the surface.

The second hydrocarbon solvent containing the first hydrocarbon solvent produced at the surface is treated in step 41 for recovery of the two hydrocarbon solvents 4 and 5 and any heavy hydrocarbon products from the extractible organics component 45. The hydrocarbon solvents 4 and 5 can be recycled to the formation.

EXAMPLE

The 2-methyltetrahydrofuran (2-MeTHF) extract of a Green River oil shale sample from the Piceance Creek Basin in Colorado, USA contained 1.49 weight percent of the fully saturated (perhydro) beta-carotene. The extraction of the organic compounds was performed in combination with supercritical carbon dioxide (81% supercritical CO2 & 19% of 2-MeTHF) under expected in-situ reservoir conditions (40° C. and 1200 psig) in a dynamic mode. Several tests have shown that the extraction is possible in temperature and pressure range of 10° C.-125° C. and 14 psig-2500 psig, respectively. The limiting factor is the thermal stability of the 2-MeTHF and organic compounds present in the oil shale.

Gas chromatography-mass spectrometry showed this extract component to have a molecular ion of m/z 558 ($C_{40}H_{78}$) and to have a mass spectrum and gas chromatographic retention time identical to that of perhydro-beta-carotene prepared by the exhaustive catalytic hydrogenation of beta-carotene. While beta-carotene is a dark-red solid with a single stereochemical configuration, fully hydrogenated beta-carotene is a bright, clear, colorless oily liquid that includes many stereochemical forms, including many diastereomers.

Simulated distillation shows fully hydrogenated beta-carotene boiled in the 930-955° F. (Atmospheric Equivalent Boiling Point, AEBP) range, and is concentrated in the vacuum gas-oil refinery distillation cuts and can make-up over 50 weight percent on such cuts of a 2-MeTHF oil shale extract. Beta-carotene is a major product biosynthesized by certain algae and saturated beta-carotene is useful as a bright stock product.

In contrast to the present processes, exhaustive hydrogenation of beta-carotene in the laboratory requires high hydrogen pressures, high temperatures and noble metal catalysts, whereas the beta-carotene in the oil shale extracts has been perhydrogenated by natural geologic processes. A saturated beta-carotene sample exhibited good lubricating properties with viscosity of 248 sCt. at 40° C., viscosity of 17 sCt. at 100° C., VI of 66, cloud point of <−78° C., and pour point of <−29° C. The BN oxidation stability of saturated beta-carotene is fair with 10.6 hrs (10.6 hours for 100 gm to absorb a liter of oxygen).

Variations

A variation (i.e., alternate embodiment) on the above-described process is the application of some or part of such above-described methods to alternative sources, i.e., low-permeability hydrocarbon-bearing (e.g., oil and gas) formations, in situ coal, in situ heavy oil, in situ oil sands, and the like. General applicability of at least some of the above-described invention embodiments to any hydrocarbon-bearing formation exists. Surface processing applications may include upgrading of oil shale, coal, heavy oil, oil sands, and other conventional oils with asphaltenes, sulfur, nitrogen, etc.

Various modifications and alterations of this invention will become apparent to those skilled in the art without departing from the scope and spirit of the invention. Other objects and advantages will become apparent to those skilled in the art from a review of the preceding description.

What is claimed is:

1. A process for isolating heavy saturated hydrocarbons from a subsurface shale formation comprising kerogen and an extractible organics component, the process comprising:

a) providing a first hydrocarbon solvent to the subsurface shale formation comprising kerogen and an extractible organics component;

b) at least partially solubilizing at least a portion of the extractible organics component in the first hydrocarbon solvent;

c) removing the first solvent containing the extractible organics component from the subsurface shale formation to a surface facility; and d) isolating a heavy hydrocarbon fraction by distillation, wherein the heavy hydrocarbon fraction is a 900° F.+ fraction and comprises saturated beta-carotene.

2. The process of claim 1, further comprising providing a second solvent to the subsurface shale formation to remove at least a portion of the first hydrocarbon solvent from the subsurface shale formation; and removing the second solvent from the subsurface shale formation.

3. The process of claim 2, wherein the first solvent is selected from the group consisting of 2-methyltetrahydrofuran, tetrahydrofuran, dichloromethane, chloroform, acetone, carbon disulfide, benzene, toluene, xylene, pyridine, n-methyl-2-pyrrolidone (NMP), cyclopentyl methyl ether (CPME), ethyl lactate, dibasic esters (DBE), propylene carbonate, dimethyl carbonate, $CO_2$, $CO_2$ at supercritical conditions, and mixtures thereof and the second solvent is selected from the group consisting of methanol, ethanol, acetone, $CO_2$, CO2 at supercritical conditions, and mixtures thereof.

4. The process of claim 3, further comprising removing the first and second solvents from the subsurface shale formation by pumping.

5. The process of claim 1, wherein the heavy hydrocarbon fraction comprises over 50 weight % saturated beta-carotene.

6. The process of claim 3, further comprising analyzing the first solvent for the extractible organics component.

7. The process of claim 1, wherein the isolated heavy hydrocarbon fraction comprising saturated beta-carotene has a kinematic viscosity of 200 to 280 cSt at 40° C., a cloud point of less than −9° C., and a pour point of less than −9° C.

8. A process for isolating heavy saturated hydrocarbons from a subsurface shale formation comprising kerogen and an extractible organics component, the process comprising:

a) providing a first hydrocarbon solvent to the subsurface shale formation comprising kerogen and an extractible organics component;

b) at least partially solubilizing at least a portion of the extractible organics component in the first hydrocarbon solvent;

c) removing the first solvent containing the extractible organics component from the subsurface shale formation to a surface facility;

d) providing a second solvent to the subsurface shale formation comprising kerogen and an extractible organics component;

e) at least partially solubilizing at least a portion of the first hydrocarbon solvent in the second solvent;

f) removing the second solvent containing the first hydrocarbon solvent from the subsurface shale formation; and g) isolating a heavy hydrocarbon fraction from the first solvent by distillation, wherein the heavy hydrocarbon fraction is a 900° F.+ fraction and comprises saturated beta-carotene.

9. The process of claim 8, wherein the heavy hydrocarbon fraction is a 900-1005° F. fraction.

10. The process of claim 8, wherein the first solvent is selected from the group consisting of 2-methyltetrahydrofuran, tetrahydrofuran, dichloromethane, chloroform, acetone, carbon disulfide, benzene, toluene, xylene, pyridine, n-methyl-2-pyrrolidone (NMP), cyclopentyl methyl ether (CPME), ethyl lactate, dibasic esters (DBE), propylene carbonate, dimethyl carbonate, $CO_2$, $CO_2$ at supercritical conditions, and mixtures thereof.

11. The process of claim 8, wherein the second solvent is selected from the group consisting of methanol, ethanol, acetone, $CO_2$, $CO_2$ at supercritical conditions, and mixtures thereof.

12. The process of claim 8, wherein the first solvent is 2-methyltetrahydrofuran and the second solvent is ethanol or $CO_2$ at supercritical conditions.

13. The process of claim 8, further comprising removing the first and second solvents from the subsurface shale formation by pumping.

14. The process of claim 8, further comprising analyzing the first solvent for the extractible organics component.

15. The process of claim 14, further comprising deciding whether to provide additional first solvent or provide second solvent based upon the analysis for the extractible organics component.

16. The process of claim 6, further comprising recycling the first and/or second solvent to the subsurface shale formation.

17. The process of claim 8, wherein the first solvent is removed by providing the second solvent.

18. The process of claim 8, wherein the heavy hydrocarbon fraction comprises over 70 weight % saturated beta carotene and has a kinematic viscosity of 200 to 280 cSt at 40° C., a cloud point of less than −9° C., and a pour point of less than −9° C.

19. A process for making a bright stock comprising:

a) providing a first hydrocarbon solvent to a subsurface shale formation comprising kerogen and an extractible organics component;

b) at least partially solubilizing at least a portion of the extractible organics component in the first hydrocarbon solvent;

c) removing the first solvent containing the extractible organics component from the subsurface shale formation to a surface facility;

d) isolating a heavy hydrocarbon fraction by distillation, wherein the heavy hydrocarbon fraction is a 900° F.+ fraction and comprises saturated beta-carotene; and e) providing the heavy fraction comprising saturated beta-carotene as a bright stock.

20. The process according to claim 19, further comprising providing a second solvent to the subsurface shale formation to remove at least a portion of the first hydrocarbon solvent from the subsurface shale formation; and removing the second solvent from the subsurface shale formation.

21. The process of claim 19, wherein the bright stock has a VI of 60 to 100, a kinematic viscosity of 180 to 300 cSt at 40° C., a cloud point of less than −9° C., and a pour point of less than −9° C.

22. A process for making a blended bright stock comprising:

(a) providing a first hydrocarbon solvent to the subsurface shale formation comprising kerogen and an extractible organics component;

(b) at least partially solubilizing at least a portion of the extractible organics component in the first hydrocarbon solvent;

(c) removing the first solvent containing the extractible organics component from the subsurface shale formation;

(d) isolating a heavy hydrocarbon fraction from the first solvent by distillation, wherein the heavy hydrocarbon fraction is a 900° F.+ fraction and comprises saturated beta-carotene;

(e) providing the heavy hydrocarbon fraction comprising saturated beta-carotene as a bright stock blending feedstock;

(f) blending the bright stock blending feedstock with a petroleum derived bright stock or a Fischer-Tropsch derived bright stock; and (g) isolating a blended bright stock.

23. The process according to claim 22, further comprising providing a second solvent to the subsurface shale formation to remove at least a portion of the first hydrocarbon solvent from the subsurface shale formation; and removing the second solvent from the subsurface shale formation.

24. The process of claim 22, wherein isolating the heavy hydrocarbon fraction is performed by distillation and the heavy hydrocarbon fraction is a 900-1005° F. fraction.

25. The process of claim 22, wherein the blended bright stock has a VI of 60 to 100, a kinematic viscosity of 180 to 300 cSt at 40° C., a cloud point of less than −9° C., and a pour point of less than −9° C.

26. The process of claim 22, further comprising blending 99 to 10 wt % of the bright stock feedstock with 90 to 1 wt % petroleum derived bright stock or Fischer-Tropsch derived bright stock.

27. The process of claim 26, further comprising blending 75 to 25 wt % of the bright stock feedstock with 75 to 25 wt % petroleum derived bright stock or Fischer-Tropsch derived bright stock.

* * * * *